United States Patent [19]

Hayashi et al.

[11] Patent Number: 4,459,837

[45] Date of Patent: Jul. 17, 1984

[54] METHOD OF INDIRECT EXTRUSION OF METAL

[75] Inventors: Hiromasa Hayashi; Eiichi Mohri, both of Nagoya, Japan

[73] Assignee: Sumito Light Metal Industries, Ltd., Tokyo, Japan

[21] Appl. No.: 346,077

[22] PCT Filed: May 26, 1981

[86] PCT No.: PCT/JP81/00114

§ 371 Date: Jan. 13, 1982

§ 102(e) Date: Jan. 13, 1982

[87] PCT Pub. No.: WO81/03441

PCT Pub. Date: Dec. 10, 1981

[30] Foreign Application Priority Data

May 26, 1980 [JP] Japan ..... 55-69964

[51] Int. Cl.[3] ..... B21C 25/02; B21C 35/04; B21C 35/06

[52] U.S. Cl. ..... 72/255; 72/273.5

[58] Field of Search ..... 72/255, 270, 272, 273, 72/273.5

[56] References Cited

U.S. PATENT DOCUMENTS

| | | | |
|---|---|---|---|
| 3,522,721 | 8/1970 | Whiting | 72/255 |
| 4,056,964 | 11/1977 | Shibasaki et al. | 72/255 |
| 4,342,212 | 8/1982 | Sibler | 72/255 |
| 4,430,877 | 2/1984 | Asari | 72/255 |

FOREIGN PATENT DOCUMENTS

| | | | |
|---|---|---|---|
| 2237276 | 2/1973 | Fed. Rep. of Germany | 72/273.5 |
| 51-35540 | of 1976 | Japan | 72/273.5 |
| 51-35541 | of 1976 | Japan | 72/273.5 |
| 22659 | 2/1976 | Japan | 72/273 |
| 52-17816 | of 1977 | Japan | 72/273.5 |
| 112257 | 9/1978 | Japan | 72/255 |
| 54-69135 | of 1979 | Japan | 72/273.5 |
| 1662 | 1/1979 | Japan | 72/273.5 |
| 1517 | 1/1982 | Japan | 72/273.5 |

*Primary Examiner*—Lowell A. Larson
*Attorney, Agent, or Firm*—Browdy and Neimark

[57] ABSTRACT

This invention provides an indirect metal extrusion method, in which free die system is adopted. A die (8) of two-stepped structure is capable of removing shell or outer layer of a billet simultaneously at the time of extrusion, and eliminating the container cleaning cycle after the extrusion. Besides, a shear support (3), an independent body of the container (2), is disposed on the nearer side of the container (2) to an extrusion ram (4), so that discard integrally clung to the die (8) may be served after finishing of an extrusion stroke off the die (8) which is rested on the shear support (3) by means of a shear (14) or a shearing apparatus. This method enables shortening of the extrusion cycle and eliminating damage to principal structure of the extruder.

8 Claims, 8 Drawing Figures

1
2
2a
3
3a
4
5
6
7
8
8a
8b
8c
9

1
2
3
4
7
8
11
12
13
14
15

METHOD OF INDIRECT EXTRUSION OF METAL

DESCRIPTION

Technical Field

This invention relates to a method of indirect extrusion of metal and, in particular, to an indirect extrusion method wherein container cleaning is simultaneously executed in the course of extrusion, and discard such as billet residual unextruded which closely adhered or clung on the die is effectively cut and separated by means of a shear.

Background Art

As a method for extruding a billet, metal material, direct extrusion has been conventionally prevailing as a main stream. Indirect extrusion method has however been in recent days adopted in some quarters because of its merit of producing comparatively less friction loss in the course of an extrusion process.

The indirect extrusion method referred to herein means a method for extruding a billet through a die without relative movement between the container and the billet. Further concretely it means a billet extrusion method in which an axially movable container, with one opening end of a billet charging hole disposed axially through a central portion thereof being closed by an extrusion or press ram, is moved while accommodating a billet and a die put therein toward a stationary hollow die stem concentrically arranged therewith.

When such indirect extrusion method is put in practice, however, treatment of thin outer layer of a billet comes up as an important problem. That is because there are generally some kinds of impurities on the surface of billets which are feared to give rise to various undesirable defects to produced articles when introduced thereinto. A device of making the diameter of the die slightly smaller than the inner diameter of the billet charging hole, for preventing introduction of the outer layer or shell of the billet into the produced articles by leaving the outer layer as a shell in the billet charging hole when the extrusion is carried out, has been developed as an effective measure to solve the problem and fairly widely practiced. In this method, however, the shell left in the billet charging hole after a stroke of extrusion must be removed, that is to say, a container cleaning cycle of removing the residual shell in the hole by utilizing some means such as a dummy block used in the extrusion is needed while moving the container or an extrusion ram on the other hand. It inevitably makes the cycle time of extrusion longer.

For the purpose of eliminating the container cleaning cycle, a sort of die having a two-stepped structure has been developed. This sort of two-stepped die is provided with a pair of large diametered portions, having a slightly smaller diameter than the inner diameter of the hole of the container, on either axial end thereof, such that the shell produced in the course of an extrusion stroke is accommodated in an annular space between the pair of large diametered portions. This device of die does not leave the shell in the hole, eliminating the container cleaning cycle indeed. It still leaves a problem how to remove the shell accumulated in the clearance of the die, because the die is secured on a die-stem. Another demeritorious problem inherent to this device is deformation and misaligning of axes of the die-stem observed when the discard consisting of the residual billet, the dummy block, etc., is severed off the die.

A free die or a loosed die has been, on the other hand, developed, wherein the die is not secured on the die-stem at all when extrusion is conducted, in consideration of inherent disadvantages in the conventional attached-die system, where the die is fixed on the end of the die-stem when extrusion is carried out, for example, a weak point feared at the fixing place of the die, scratching or damaging of the inner surface of the container hole by the shell clung to the outer surface of the die. In this free die system there is still a serious problem how to cut off, in every cycle of extrusion, an integrated block consisting of the die, the residual billet left there, the dummy block, etc., from the produced articles. Two ways are generally thought of the severance of the discard, an integrated block of the residual billet, the dummy block, etc., from the die, that is, from the products, a way of utilizing a hot saw, i.e., a rotary blade, and a way of utilizing a shear, i.e., a shearing apparatus. There are many restrictions in respect of cutting capability and operability in the former way, the hot saw, such as difficulty in cutting products in rod state due to clogging of the saw tooth, how to fix a plurality of products in the event of extrusion with a poly-hole die, etc., so the latter way is preferred in general. The shearing system is, however, still hauntedly some problems, such as reaction applied directly on the container, when the discard is cut off, because of holding the die by the container, consequent deterioration of the axial straightness of the container hole and possible damage on the inner surface of the container hole.

It is an object of this invention, which was made from such a background, to provide an indirect extrusion method wherein container cleaning cycle after the extrusion is eliminated and consequently shortens the extrusion time as well as extremely facilitates removal of the discard after every extrusion stroke.

It is another object of this invention to provide an indirect extrusion method wherein the life of the container, the die and other parts is elongated by evading damages on principal structures of the extrusion apparatus, and maintaining of precise axis of the container is made remarkably easy.

Disclosure of Invention

According to this invention, the method of indirect extrusion of metal comprises steps of:

arranging a later described die at one end of a stationary and hollow die-stem without fixing it on the die-stem;

moving a container, with a billet being charged within a billet charging hole axially bored through the central portion thereof, and being closed on one opening end of the billet charging hole by an extrusion ram, in the direction of the die-stem; and extruding a predetermined metal product into a hollow space of the die-stem by way of the die, and the method is further characterized in that the die is of two stepped structure having a pair of large diametered portions on either axial end thereof, the front large diametered portion in the extrusion direction being slightly larger in the value of the diameter than the rear large diametered portion, for forming an annular space therebetween so that shell of the billet is flowed into the annular space when the billet is extruded; and that a shear support separately made from the container is disposed on the other end of the container faced to an extrusion ram for retaining the projected die thereon from the above-mentioned container by the movement thereof when the extrusion of the billet is finished and severing an integrally clung discard consisting of residual billet, a dummy block, etc., off the die at the end surface of the die on the side faced to the extrusion ram by means of a shear.

In short, this invention developed a novel indirect metal extrusion method, for completely eliminating the conventional disadvantages inherent to the attached-die system such as the damage on the inner surface of the container and the die consequent, shortening of life of those members, etc., wherein a specifically designed die of two-stepped shape is utilized for concurrently performing the removal of billet shell in the course of an extrusion so as to eliminate the container cleaning cycle after the extrusion, and on the other hand a shear support which is separately made from the container and disposed on the side thereof faced to an extrusion ram serves, when discard closely clung onto the die is severed from the die upon finishing of one stroke of the extrusion by a shear (shearing device), in retaining the discard thereon. The present invention has in this way solved all of the problems in the traditional indirect extrusion process(es).

BRIEF DESCRIPTION OF DRAWINGS

FIGS. 1 through 7 are all respectively a schematic sectional view of an essential part of an embodiment of an extrusion method, according to this invention, for showing a series of processed step by step, in which:

FIG. 1 shows a billet placed by a billet loader on an extrusion axial line;

FIG. 2 shows a set status of the billet in the container and a set status of the die;

FIG. 3 shows a status immediately before starting of the extrusion;

FIG. 4 shows a status when the extrusion has just been finished;

FIG. 5 shows a status when the discard is just going to be severed off;

FIG. 6 shows a status when the discard has just been severed off;

FIG. 7 shows a status when the die has been taken out; and

BEST MODE OF CARRYING OUT THE INVENTION

Figures 1, 2, 3:
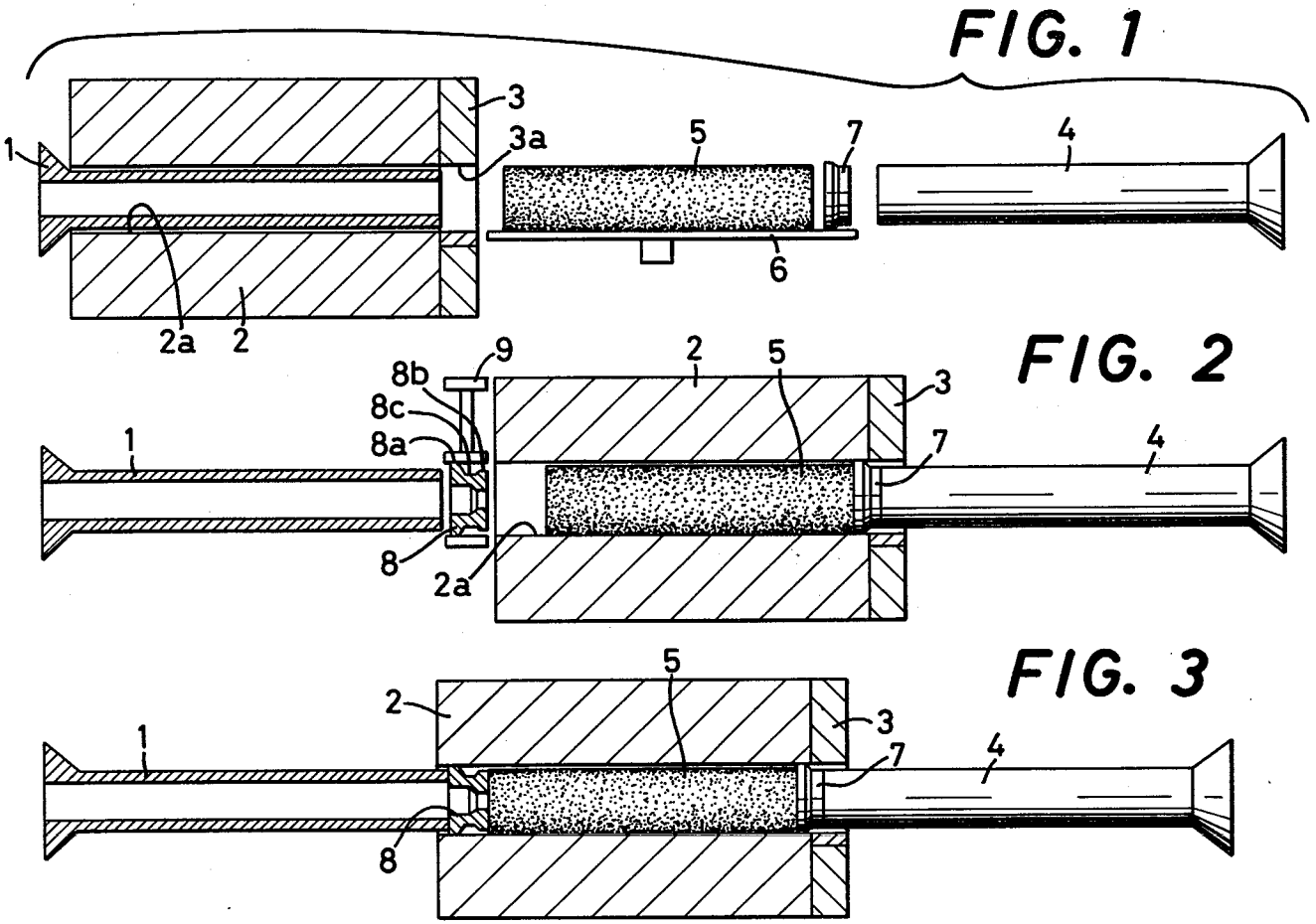

With reference to the appended drawings which have been explained above, the invention will be described more in detail hereunder.

An extrusion process according to this invention is schematically illustrated, in respect of the essential part thereof, as a timewise series of processes ranging from FIG. 1 to FIG. 7. In each figure, numeral 1 designates a hollow die-stem, which is secured at the left side end thereof to a suitable stationary fixing means (not shown). A container 2 having a billet charging hole 2*a* bored though the central portion thereof is concentrically and laterally (in figures) movably disposed with the die-stem 1. An extrusion or press ram 4 concentrically disposed on opposite side of the container 2 therewith is movably retained by a suitable retainer (not shown) toward the die-stem 1. On one end of the container 2 faced to the die-stem 1 a shear support 3 is disposed as an independent body from the die-stem 1 but synchronously movable with the container 2. The shear support 3 therefore does not deliver a force which is applied thereon to the container 2. A through-bore 3*a* is formed in the shear support 3 at the corresponding position to the billet charging hole 2*a* of the container 2.

For extruding the billet 5, a metallic material, it must be first of all placed on the extrusion axial line, as shown in FIG. 1, by a suitable means, for example, by a billet loader 6. Soon after the mounting of the billet 5 on the billet loader 6 an urging piece, i.e., a dummy block 7 with an external diameter slightly smaller than the inner diameters of the billet charging hole 2*a* of the container 2 is arranged at just registered position with the billet 5. While the container 2 is shifted rightwardly (in FIG. 2) together with the shear support 3, the billet 5 on the loader 6 and the dummy block 7 are inserted, leaving the loader 6, into the billet charging hole 2*a* by means of a suitable billet inserting means passing through the through-bore 3*a* in the shear support 3. The shifting of the container 2 is continued until the dummy block 7 reaches a position where it is urged by the end surface of the extrusion ram 4 (see FIG. 2).

Figure 8:
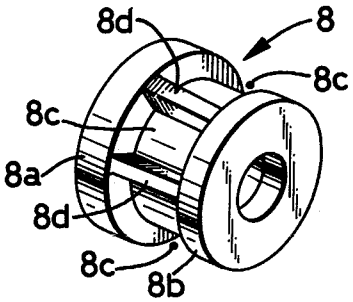
FIG. 8 is a perspective view of a die most suitable for practicing the method of this invention.

After the halting of the container 2 and the shear support 3 a die 8 of a predetermined two-stepped structure is supplied by a die loader 9 onto the end surface of the die-stem 1 (see FIG. 2). This die 8 is, as shown in FIG. 8, provided with a pair of large diametered portions 8*a*, 8*b* on either axial end thereof, respectively with an external diameter slightly smaller than the inner diameter of the billet charging hole 2*a* of the container 2, for forming an annular space or clearance (recessed portion) 8*c* therebetween. One large diametered portion 8*a* on the front side (outlet side of the die), in respect of the extrusion direction, is a little larger in its diameter than the other large diametered portion 8*b* on the rear side (inlet side of the die where in contacts the billet) for the purpose of receiving outer layer or shell scraped off the billet 5 into the recessed clearance 8*c* so as to remove it in the course of the extrusion. Besides, the die 8 of the two-stepped structure is provided with a plurality of axially arranged separating walls 8*d* so as to link the pair of large diametered portions 8*a*, 8*b* for the purpose of dividing the flowed-in shell of the billet into pieces so that they may be easily accumulated there. Removal of the shell is made easy a great deal by the above-mentioned structure.

The die 8 supplied by the die loader 9 for abutting onto the end of the die-stem 1 is not fixed by any means, but freely attached as in the conventional free die system.

Upon finishing of the die loading, the container 2 and the extrusion ram 4 are advanced together leftwardly (in the illustration) until the die 8 mounted on the tip of the die-stem 1 comes in the billet charging hole 2*a* of the container 2 as far as it abuts on the billet 5 (see FIG. 3). Then far greater urging force is applied to the container 2 and the extrusion ram 4 so that it is delivered to the billet 5 via the dummy block 7. The billet 5 is gradually extruded through an opening in the die 8, and an extruded product 11 in the die-stem 1 is finally taken out of the hollow space there.

In the meantime harmful billet shell is flowed in, through a small gap between the inner surface of the billet charging hole 2*a* and the external periphery of the rear side large diametered portion 8*b* of the die 8 with a smaller diameter than that of the hole 2*a*, the recessed clearance 8*c* for being accumulated there. Numeral 12 designates the accumulated billet shell. Incidentally, the small gap between the inner surface of the billet charging hole 2*a* and the external periphery of the rear side large diametered portion 8*b* must be determined according to material quality of the billet and extrusion conditions. The advancement of the container 2 and the extrusion ram 4 is halted with some unextruded residual 13 left as illustrated in FIG. 4.

AT this stage an after treatment process is started by retracting the extrusion ram backwardly. The residual 13 is projected from the container 2 as illustrated in FIG. 5 so that the die 8 may be perfectly positioned in the throughbore 3*a* of the shear support 3, which has been synchronously moved thereto with the container 2, due to further advance of the container 2. When the end surface of the die 8 on the inlet side thereof and the end surface of the shear support 3 on the side faced to the extrusion ram 4 are just aligned a shear 14 (a shearing blade) which has been descended along the end surface of the shear support 3 severs the discard including the residual 13 and the dummy block 7 off the die 8. A reactionary force produced then by the shearing force applied on the die 8 by the shear 14 is born by the shear support 3 alone so that the die-stem 1 and the container 2 may not be affected. Because the shear support 3 is made independent of the container 2 and the die 8 is also freely abutted on the end of the die-stem 1, according to the so-called free die system. The discard cut off the front surface of the die 8 is instantly received by a waste taker 15 for being carried away out of the apparatus. The dummy block 7 which constitutes a part of the took out discard is separated from the rest for being recycled to the routine operational use.

Figures 4, 5, 6:
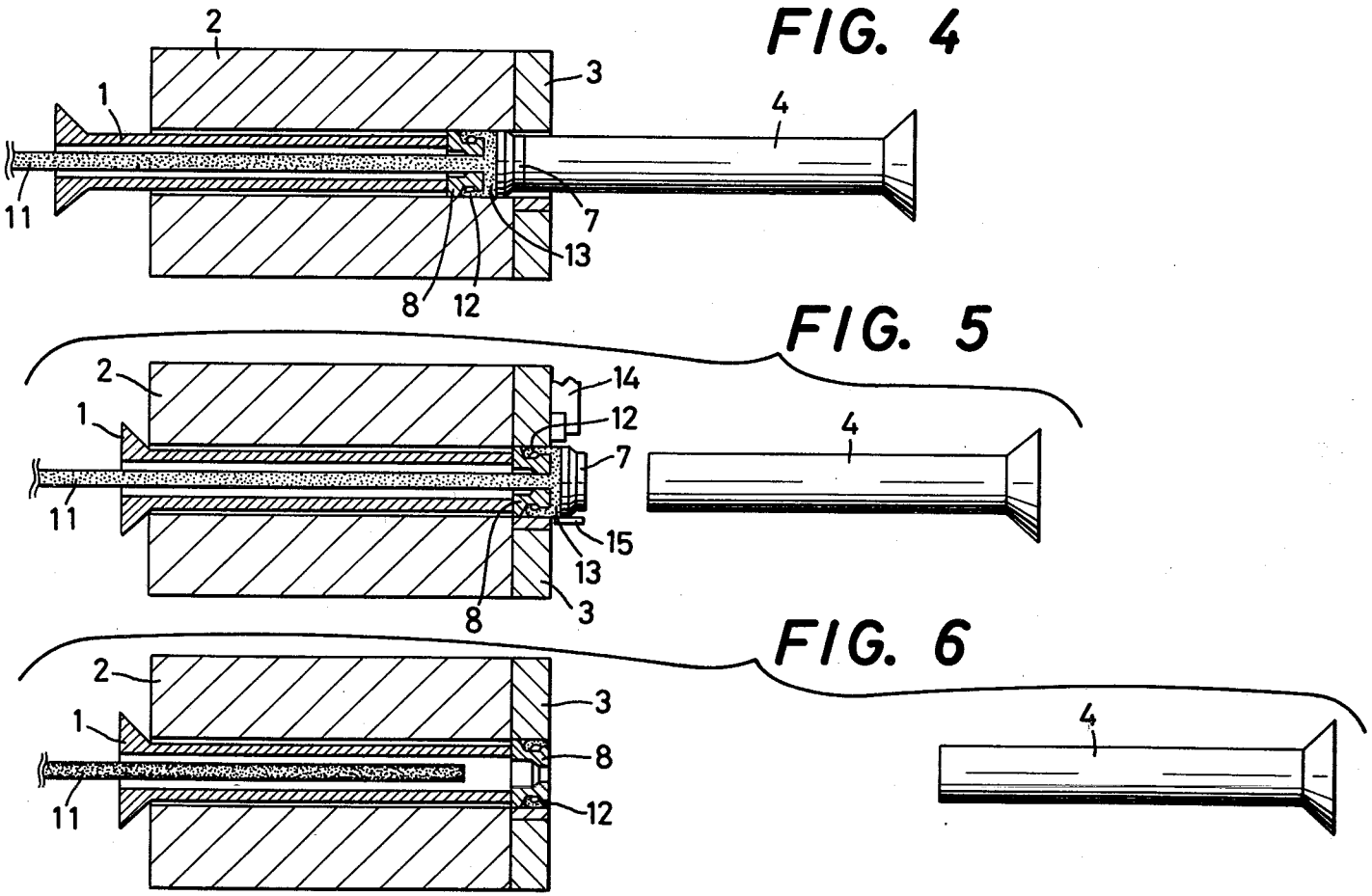
Figure 7:
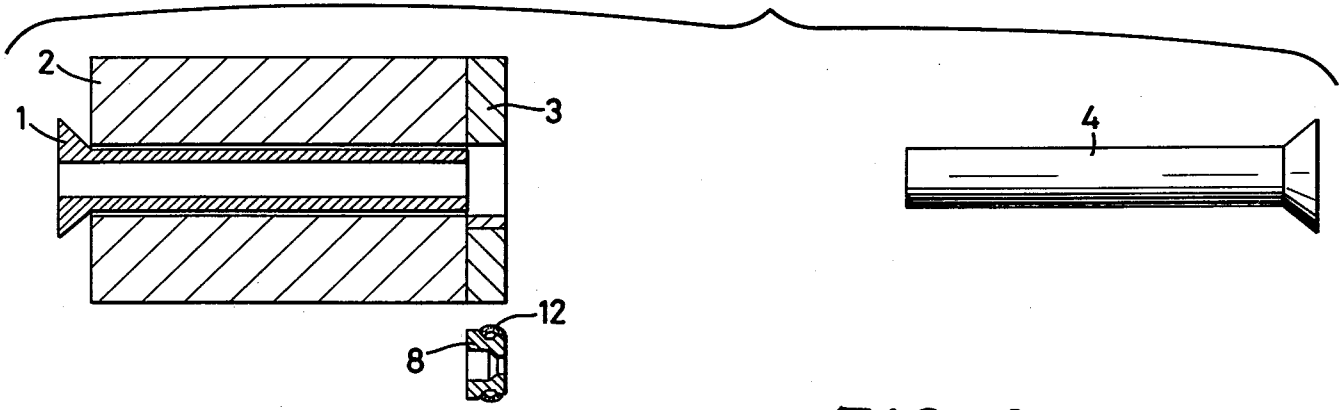

Parallelly to the severance of the discard from the die 8, the product 11 is pulled out of the die-stem 1 by a suitable way (see FIG. 6). The die 8 left in the throughbore 3*a* of the shear support 3 must be taken out by a suitable means (see FIG. 7), with the accumulated billet shell 12 in the clearance 8*c* thereof. The die 8 is of course restored to its re-use through removal of the accumulated shell 12 by a proper means. The extrusion ram 4 is restored to its original position at this moment.

The above description is for one cycle of the extrusion in this invention. According to the series of processes shown in the FIGS. 1 to 7, a second cycle is started herewith. Having a spare die 8 or dies is preferable for shortening the extrusion time. The time required for removing the shell from the die 8 can be reduced from the cycling time for one stroke of extrusion.

To summarize the present invention which has been described in detail above in the order of processes of one cycle extrusion, it is distinguishably characterized in, by means of adopting the indirect extrusion by the so-called free die system, utilizing a two-stepped die, and making good use of the shear support, having eliminated the container cleaning cycle, having evaded damage on the principal extruding system, having elongated the life of the container and the die, having remarkably enhanced the maintaining of exact axis of the container, and having highly improved the cutting operation of a rod, particularly a thick rod.

This invention is of course not limited to the above described embodiment, but may be variously altered or modified by those skilled in the art without departing from the spirit and scope of the invention. For example, any of dies may be practicable so long as they are of the two-stepped structure. The shear support, which is moved in synchronization of the container in the above embodiment, is allowed to move independently of the container.

Although the invention was developed as an indirect extrusion for a billet (round rod), particularly of aluminum and alloys thereof, (round rod), particularly of aluminum and alloys thereof, it may be effectively applied to the extrusion of other metals such as copper or alloys thereof.

As to the extruded products by the method according to this invention, the indirect extrusion of pipes and angles are also allowed, in addition to the above-mentioned round rods.

We claim:

1. A method of indirectly extruding a billet through a die on an apparatus including a stationary hollow die stem, a container accommodating the billet in a billet receiving hole axially formed therein concentrically with said die stem, an extrusion ram concentric with said billet receiving hole and adapted to close one end of the billet receiving hole, and a shear support separate from said container and positioned adjacent to one end of the container on the side of said one end of the billet receiving hole, said die including a pair of axially spaced large-diameter portions consisting of a front portion at one end of the die and a rear portion at the other end of the die, said front portion having a diameter slightly smaller than an inside diameter of said billet receiving hole and slightly greater than that of said rear portion, said method comprising the steps of:

positioning said die at one end of said die stem with said front portion held in abutting, non-fixed relation with said one end of the die stem;

closing said one end of the billet receiving hole by said extrusion ram;

moving said container and said extrusion ram toward said die stem for pushing one end of the billet in said receiving hole and thereby extruding the billet at the other end thereof through said die to provide an extruded product in said die stem, while at the same time permitting an outer layer of the billet to be accumulated as a residual shell in an annular space which is defined by the inner surface of said billet receiving hole and the outer peripheral surface of said die, said outer layer of the billet flowing into said annular space through a clearance between said inside diameter of said receiving hole and the diameter of said rear portion of said die which is slightly smaller than said inside diameter;

upon completion of the extrusion of said billet, moving said container synchronously with said shear support to position said die and a discard outside said one end of said billet receiving hole and to thereby hold said die in said shear support such that a shearing force applied to said die and discard is not imparted to said die stem and said container upon severing of said discard positioned outside said shear support, said discard including a residual unextruded material and a dummy block;

severing said discard from said residual shell and said extruded product by moving a shear along the end surfaces of said shear support and said die;

pulling said extruded product out of said die stem; and removing said die with said residual shell out of said shear support.

2. A method as set forth in claim 1, wherein said billet is made of aluminum or an aluminum alloy.

3. A method as set forth in claim 1, wherein said residual shell is accumulated in the form of pieces accommodated in respective segment of said annular space which are formed by a plurality of separating walls axially extending between said large-diameter portions and spaced circumferentially of the latter.

4. A method as set forth in claim 1, wherein said die is removed out of a central bore formed in said shear support in aligned relation with said billet receiving hole.

5. An apparatus for indirectly extruding a billet, comprising:

a stationary hollow die stem;

a container having a billet receiving hole formed axially thereof in aligned relation with said die stem for accommodating the billet, said container being movable with respect to said die stem;

an extrusion ram disposed in aligned relation with and movably into said billet receiving hole to close one end thereof and abut on one end of the billet, said extrusion ram being movable together with said container relative to said die stem for extrusion of the billet to produce an extruded product in said die stem;

a die positioned at one end of the die stem in concentrically aligned relation with said billet receiving hole, said die including a pair of axially spaced large-diameter portions having diameters slightly smaller than an inside diameter of said billet receiving hole, said large diameter portions consisting of a front portion at one end of the die on the side of said die stem and a rear portion at the other end of the die, said front portion having a diameter slightly greater than that of said rear portion, said front portion being held in abutting, non-fixed relation with said one end of the die stem during the extrusion of the billet, the outer peripheral surface of said die cooperating with the inner surface of said billet receiving hole to define, substantially between said front and rear portions, an annular space in which an outer layer of the billet is accumulated as a residual shell during the extrusion of the billet through said die; and a shear support provided in independent and separate relation with and synchronously movably together with said container and disposed adjacent to one end of said container on the side of said one end of the billet receiving hole, said shear support having a bore concentric with said billet receiving hole for holding said die which is projected beyond said one end of the container upon severing of a discard from said residual shell and the extruded product at the end of the extrusion of the billet, whereby no shearing force applied to said die is imparted to said die stem and said container.

6. An apparatus as set forth in claim 5, wherein said die further includes a plurality of separating walls axially extending between said large-diameter portions and spaced circumferentially of the latter so as to divide said annular space into segments for accumulation of said residual shell in pieces.

7. An apparatus as set forth in claim 5, which further comprises a shear which is movable radially of said shear support along the end surfaces of the shear suppot and said die to sever said discard.

8. An apparatus as set forth in claim 5, further comprising a dummy block interposed between said extrusion ram and said one end of the billet, said discard including a residual unextruded material of the billet and said dummy block.

* * * * *